US008146647B1

(12) United States Patent
Hughes et al.

(10) Patent No.: US 8,146,647 B1
(45) Date of Patent: Apr. 3, 2012

(54) SCREEN CLIPPING SYSTEM AND CLIPS THEREFOR

(76) Inventors: Brian G. Hughes, Indian Lakes Estates, FL (US); Brian E. Jones, Hoschton, GA (US)

( * ) Notice: Subject to any disclaimer, the term of this patent is extended or adjusted under 35 U.S.C. 154(b) by 107 days.

(21) Appl. No.: 12/798,843

(22) Filed: Apr. 13, 2010

(51) Int. Cl.
*E06B 9/52* (2006.01)

(52) U.S. Cl. ..... 160/371; 160/392; 52/202; 52/222

(58) Field of Classification Search ..... 160/371, 160/392, 395, 327; 52/222, 63, 202; 29/896.6; 38/102.91; 40/761
See application file for complete search history.

(56) References Cited

U.S. PATENT DOCUMENTS

| | | | | | |
|---|---|---|---|---|---|
| 3,914,887 | A * | 10/1975 | Newman | 38/102.8 |
| 4,194,312 | A * | 3/1980 | Connors et al. | 38/102.5 |
| 4,265,039 | A * | 5/1981 | Brooks | 40/603 |
| 4,409,749 | A * | 10/1983 | Hamu | 38/102.3 |
| 4,682,642 | A * | 7/1987 | Hogshead et al. | 160/392 |
| 5,794,400 | A * | 8/1998 | Fisher et al. | 52/844 |
| 6,983,524 | B2 * | 1/2006 | Eastwood | 29/428 |

* cited by examiner

*Primary Examiner* — Blair M. Johnson

(57) ABSTRACT

A frame has a circumferential slot and a circumferential chamber. Each of a plurality of similarly configured clips has a base and a leg. A screen has an attachment region through the slot and within the chamber. The leg of each clip is in contact with the attachment region of the screen. An elongated flexible spline is located within the chamber in contact with the attachment region of the screen. The clip is adapted to hold the screen in position with respect to the frame until the spline is inserted into the chamber in contact with the attachment region of the screen for securement purposes.

3 Claims, 2 Drawing Sheets

FIG 1
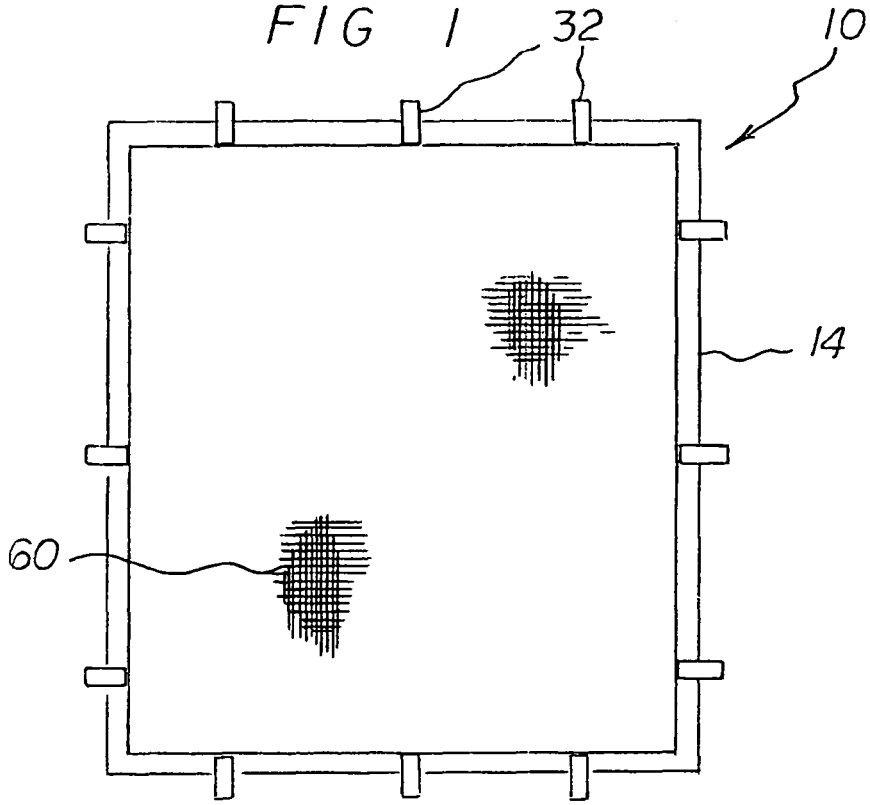
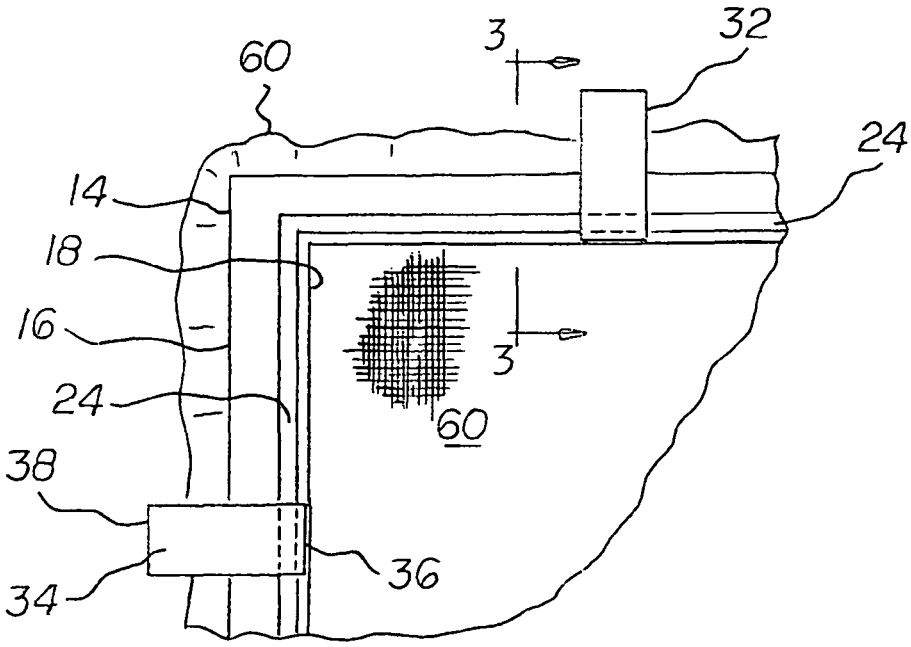
FIG 2

FIG 3
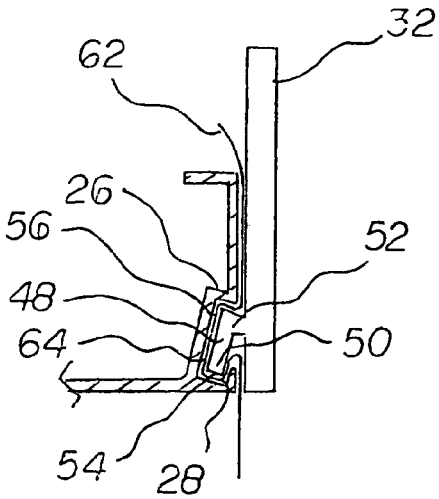
FIG 4
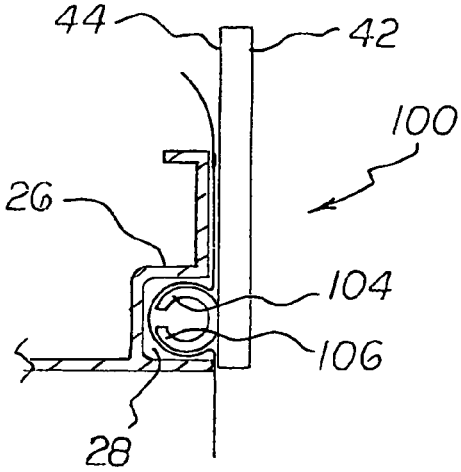
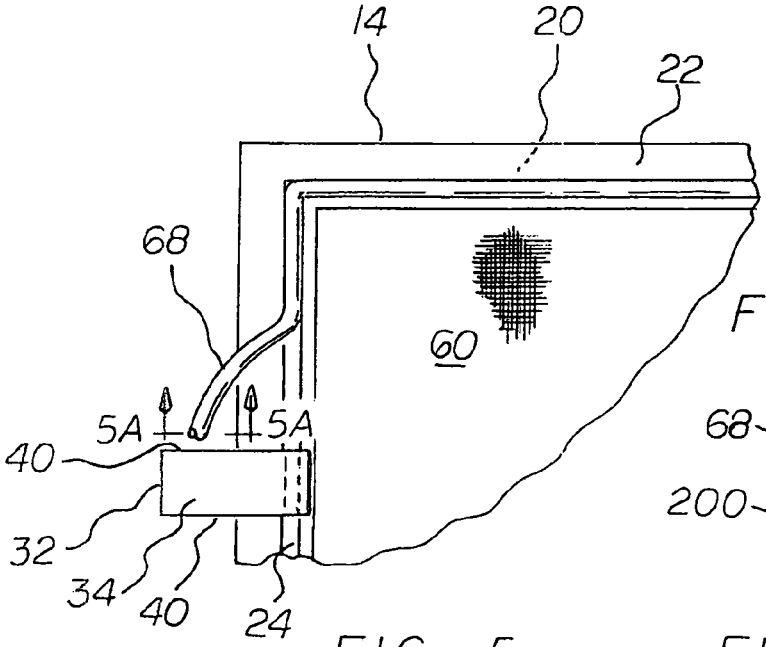
FIG 5
FIG 5A
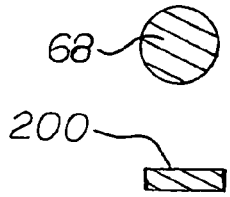
FIG 5B

SCREEN CLIPPING SYSTEM AND CLIPS THEREFOR

BACKGROUND OF THE INVENTION

Field of the Invention

The present invention relates to a screen clipping system and more particularly pertains to coupling a screen to a frame, the coupling being done in a safe, reliable, convenient and economical manner.

SUMMARY OF THE INVENTION

In view of the foregoing disadvantages inherent in the known types of screen systems of known designs and configurations now present in the prior art, the present invention teaches an improved screen clipping system and clips therefor. As such, the general purpose of the present invention, which will be described subsequently in greater detail, is to teach a new and improved screen clipping system and clips therefor and method which has all the advantages of the prior art and none of the disadvantages.

To attain this, the present invention essentially comprises a screen clipping system and clips therefor. First provided is a frame. The frame is preferably formed in a rectangular configuration. The frame has an outer surface. The frame has an inner surface. An opening is provided through the frame. The frame has an imperforate planar first face. The frame has a perforate planar second face. The second face is provided parallel with the first face. The first and second faces couple the inner and outer surfaces. In this manner a circumferential housing is formed within the surfaces and faces. The second face has an elongated slot along the entire length of the face. The slot is provided closer to the inner surface than the outer surface. An interior wall is provided. The interior wall is provided within the housing parallel with the inner and outer surfaces between the slot and the outer surface. In this manner a circumferential chamber is formed. The circumferential chamber is bounded by the interior wall and the inner surface and the first and second faces.

Frames of other configurations are adapted to be utilized in the present invention. Such other configurations include, without limitation, circular shapes, hexagonal shapes and other geometric shapes.

A plurality of similarly configured clips is provided. Each clip has a rectangular base. The base has an interior edge. The base has a parallel exterior edge. The interior and exterior edges are spaced by a length of 2 inches plus or minus 10 percent. Each base has parallel side edges. The side edges couple the interior and exterior edges. The side edges are spaced by a width of 1 inch plus or minus 10 percent. Each base has an outward face. Each base has a parallel inward face. The inward face is provided in contact with the second face of the frame. The interior edge of each base overlies the inner surface of the frame. The inward face extends beyond the outer surface of the frame.

Provided next is a leg. The leg is in a generally L-shaped configuration. The leg has an end section. The leg has an intermediate section. The leg has a free end. The leg has a joining end. The end section is linear with a free end and the joining end. The free end forms an angle of between 25 and 35 degrees with respect to the base. The end section faces the interior edge of the base. The intermediate section faces the exterior edge of the base. The intermediate section couples the joining end of the end section with the inward face of the base. The end section has a length between 15 and 25 percent of the length of the base. The intermediate section has a length between 10 and 20 percent of the length of the end section. The clips are fabricated of polyvinyl chloride. The base has a thickness of 0.125 inches, plus or minus 10 percent. The leg has a thickness between 40 and 60 percent of the thickness of the base. The free end of the leg is adjacent to the interior edge of the base.

Further provided is a screen. The screen has a periphery. The screen has a rectangular attachment region. The attachment region is adjacent to the periphery. The attachment region is located within the chamber. The leg of each clip is in contact with the attachment region of the screen. The leg is located within the chamber. The free end faces the interior wall. The intermediate section faces toward the inner face.

Provided last is an elongated flexible spline. The spline is located within the chamber. The spline is provided in contact with the attachment region of the screen. The clip is adapted to hold the screen in position with respect to the frame until the spline is inserted into the chamber in contact with the attachment region of the screen for securement purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved screen clipping system and clips therefor which has all of the advantages of the prior art screen systems of known designs and configurations and none of the disadvantages.

It is another object of the present invention to provide a new and improved screen clipping system and clips therefor which may be easily and efficiently manufactured and marketed.

It is further object of the present invention to provide a new and improved screen clipping system and clips therefor which is of durable and reliable constructions.

An even further object of the present invention is to provide a new and improved screen clipping system and clips therefor which is susceptible of a low cost of manufacture with regard to both materials and labor, and which accordingly is then susceptible of low prices of sale to the consuming public, thereby making such screen clipping system and clips therefor economically available to the buying public.

Even still another object of the present invention is to provide a screen clipping system and clips therefor for coupling a screen to a frame, the coupling being done in a safe, reliable, convenient and economical manner.

Lastly, it is an object of the present invention to provide a new and improved screen clipping system and clips therefor. A frame has a circumferential slot and a circumferential chamber. A plurality of similarly configured clips is provided. Each clip has a base and a leg. A screen has an attachment region. The attachment region is provided through the slot and located within the chamber. The leg of each clip is provided in contact with the attachment region of the screen. An elongated flexible spline is located within the chamber in contact with the attachment region of the screen. The clip is adapted to hold the screen in position with respect to the frame until the spline is inserted into the chamber in contact with the attachment region of the screen for securement purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a screen clipping system and clips therefor constructed in accordance with the principles of the present invention.

FIG. 2 is an enlarged front elevational view of a portion of the screen clipping system and clips therefor shown in FIG. 1.

FIG. 3 is a cross sectional view taken along line 3-3 of FIG. 2.

FIG. 4 is a cross sectional view similar to FIG. 3 but illustrating an alternate embodiment of the invention.

FIG. 5 is a front elevational view similar to FIG. 2 but with a spline being positioned while one of the clips is being removed.

FIG. 5A is a cross sectional view taken along line 5A-5A of FIG. 5.

FIG. 5B is a cross sectional view similar to FIG. 5A but illustrating an alternate embodiment of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved screen clipping system and clips therefor embodying the principles and concepts of the present invention and generally designated by the reference numeral 10 will be described.

The present invention, the screen clipping system and clips therefor 10 is comprised of a plurality of components. Such components in their broadest context include a frame, a plurality of similarly configured clips, a screen and an elongated flexible spline. Such components are individually configured and correlated with respect to each other so as to attain the desired objective.

First provided is a frame 14. The frame is formed in a rectangular configuration. The frame has an outer surface 16. The frame has an inner surface 18. An opening is provided through the frame. The frame has an imperforate planar first face 20. The frame has a perforate planar second face 22. The second face is provided parallel with the first face. The first and second faces couple the inner and outer surfaces. In this manner a circumferential housing is formed within the surfaces and faces. The second face has a slot 24. The slot is provided closer to the inner surface than the outer surface. An interior wall 26 is provided. The interior wall is provided within the housing parallel with the inner and outer surfaces between the slot and the outer surface. In this manner a circumferential chamber 28 is formed. The circumferential chamber is bounded by the interior wall and the inner surface and the first and second faces.

A plurality of similarly configured clips 32 is provided. Each clip has a rectangular base 34. The base has an interior edge 36. The base has a parallel exterior edge 38. The interior and exterior edges are spaced by a length of 2 inches plus or minus 10 percent. Each base has parallel side edges 40. The side edges couple the interior and exterior edges. The side edges are spaced by a width of 1 inch plus or minus 10 percent. Each base has an outward face 42. Each base has a parallel inward face 44. The inward face is provided in contact with the second face of the frame. The interior edge of each base overlies the inner surface of the frame. The inward face extends beyond the outer surface of the frame.

Provided next is a leg 48. The leg is in a generally L-shaped configuration. The leg has an end section 50. The leg has an intermediate section 52. The leg has a free end 54. The leg has a joining end 56. The end section is linear with a free end and the joining end. The free end forms an angle of between 25 and 35 degrees with respect to the base. The end section faces the interior edge of the base. The intermediate section faces the exterior edge of the base. The intermediate section couples the joining end of the end section with the inward face of the base. The end section has a length between 15 and 25 percent of the length of the base. The intermediate section has a length between 10 and 20 percent of the length of the end section. The clips are fabricated of polyvinyl chloride. The base has a thickness of 0.125 inches, plus or minus 10 percent. The leg has a thickness between 40 and 60 percent of the thickness of the base. The free end of the leg is adjacent to the interior edge of the base.

Further provided is a screen 60. The screen has a periphery 62. The screen has a rectangular attachment region 64. The attachment region is adjacent to the periphery. The attachment region is located within the chamber. The leg of each clip is in contact with the attachment region of the screen. The leg is located within the chamber. The free end faces the interior wall. The intermediate section faces toward the inner face.

Provided last is an elongated flexible spline 68. The spline is located within the chamber. The spline is provided in contact with the attachment region of the screen. The clip is adapted to hold the screen in position with respect to the frame until the spline is inserted into the chamber in contact with the attachment region of the screen for securement purposes.

An alternate embodiment 100 of the present invention is provided. Note FIG. 4. The leg is formed of two semi-cylindrical portions 104, 106. The semi-cylindrical portions are spaced from each other. The semi-cylindrical portions have limited flexibility and resilience for being inserted through the slot. In this manner the screen is held in place.

Another alternate embodiment of the present invention is provided. Note FIG. 5B. Spline 200 is provided. The spline is in a generally flat rectangular cross sectional configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A screen clipping system comprising:

a frame formed with a circumferential slot and a circumferential chamber;

a plurality of similarly configured clips, each clip having a base and a leg, each base having an interior edge facing an interior of the frame and an exterior edge facing away from the frame, each leg being formed in a generally L-shaped configuration with an end section and an intermediate section, the end section being linear with a free end and a joining end, the free end forming an angle of between 25 and 35 degrees with respect to the base, the end section facing the interior edge, the intermediate section facing the exterior edge, the intermediate section coupling the joining end of the end section with the base;

a screen having an attachment region extending through the slot and located within the chamber with the leg of each clip being in contact with the attachment region of the screen; and an elongated flexible spline located within the chamber in contact with the attachment region of the screen, the clip adapted to hold the screen in position with respect to the frame until the spline is inserted into the chamber in contact with the attachment region of the screen for securement purposes.

2. A screen clipping system comprising:

a frame formed with a circumferential slot and a circumferential chamber;

a plurality of similarly configured clips, each clip having a base and a leg;

a screen having an attachment region extending through the slot and located within the chamber with the leg of each clip being in contact with the attachment region of the screen; and an elongated flexible spline located within the chamber in contact with the attachment region of the screen, the clip adapted to hold the screen in position with respect to the frame until the spline is inserted into the chamber in contact with the attachment region of the screen for securement purposes, each leg being formed of two semi-cylindrical portions (104), (106) spaced from each other, the semi-cylindrical portions having limited flexibility and resilience for being inserted through the slot to hold the screen in place.

3. A screen clipping system (10) for coupling a screen to a frame, the coupling being done in a safe, reliable, convenient and economical manner, the system comprising, in combination:

a frame (14) formed in a rectangular configuration having an outer surface (16) and an inner surface (18) with an opening through the frame, the frame having an imperforate planar first face (20) and a perforate planar second face (22) parallel with the first face, the first and second faces coupling the inner and outer surfaces to form a circumferential housing within the surfaces and faces, a slot (24) in the second face closer to the inner surface than the outer surface, an interior wall (26) within the housing parallel with the inner and outer surfaces between the slot and the outer surface to form a circumferential chamber (28) bounded by the interior wall and the inner surface and the first and second faces;

a plurality of similarly configured clips (32), each clip having a rectangular base (34) with an interior edge (36) and a parallel exterior edge (38) spaced by a length of 2 inches plus or minus 10 percent, each base having parallel side edges (40) coupling the interior and exterior edges spaced by a width of 1 inch plus or minus 10 percent, each base having an outward face (42) and a parallel inward face (44) in contact with the second face of the frame, the interior edge of each base overlying the inner surface of the frame, and the inward face extending beyond the outer surface of the frame, a leg (48) coupled to the base adjacent to the exterior edge of the base, the leg being formed in a generally L-shaped configuration formed of an end section (50) and an intermediate section (52), the end section being linear with a free end (54) and a joining end (56), the free end forming an angle of between 25 and 35 degrees with respect to the base, the end section facing the interior edge of the base, the intermediate section facing the exterior edge of the base, the intermediate section coupling the joining end of the end section with the inward face of the base, the end section having a length between 15 and 25 percent of the length of the base, the intermediate section having a length between 10 and 20 percent of the length of the end section, the clips being fabricated of polyvinyl chloride, the base having a thickness of 0.125 inches, plus or minus 10 percent, the leg having a thickness between 40 and 60 percent of the thickness of the base, the free end of the leg being adjacent to the interior edge of the base;

a screen (60) having a periphery (62) with a rectangular attachment region (64) adjacent to the periphery, the attachment region being located within the chamber with the leg of each clip being in contact with the attachment region of the screen, the leg located within the chamber with the free end facing the interior wall and with the intermediate section facing toward the inner face; and an elongated flexible spline (68) located within the chamber in contact with the attachment region of the screen, the clip adapted to hold the screen in position with respect to the frame until the spline is inserted into the chamber in contact with the attachment region of the screen for securement purposes.

* * * * *